United States Patent [19]

Lohner et al.

[11] Patent Number: 4,682,142

[45] Date of Patent: Jul. 21, 1987

[54] ROTARY POTENTIOMETER WITH SWITCH

[75] Inventors: Martin Lohner, Balingen; Fritz Prestel, Hausen a. Tann, both of Fed. Rep. of Germany

[73] Assignee: BSG-Schalttechnik GmbH & Co. KG, Balingen, Fed. Rep. of Germany

[21] Appl. No.: 855,810

[22] Filed: Apr. 24, 1986

[30] Foreign Application Priority Data

Apr. 24, 1985 [DE] Fed. Rep. of Germany ..... 3514708

[51] Int. Cl.[4] ..... H01C 10/36

[52] U.S. Cl. ..... 338/172; 338/184; 338/198; 338/199; 338/202

[58] Field of Search ..... 338/172, 171, 198, 200, 338/201, 202, 163, 164, 184, 199, 197

[56] References Cited

U.S. PATENT DOCUMENTS 4,081,782 3/1978 Hildreth et al. ..... 338/200

4,117,444 9/1978 Hildreth et al. ..... 338/198

FOREIGN PATENT DOCUMENTS 2746481 4/1979 Fed. Rep. of Germany .

*Primary Examiner*—C. L. Albritton

*Attorney, Agent, or Firm*—McAulay, Fields, Fisher, Goldstein & Nissen

[57] ABSTRACT

A rotary potentiometer is provided with a switch, preferably as a final control element for the control of electrical machinery. An enclosed, prefabricated rotary potentiometer component with its own casing is inserted in a cup-shaped upper casing that is open on one side. Switching contact supports are housed in the upper casing by means of peripheral wall sections. These contact supports are actuated by a cam actuating member that is mounted on a fulcrum pin so as to permit play and simultaneously also effect rotation and retention of the potentiometer component in the upper casing.

10 Claims, 4 Drawing Figures

ROTARY POTENTIOMETER WITH SWITCH

DESCRIPTION OF THE PRIOR ART

The invention starts out from a rotary potentiometer with switch of the type specified in the preamble of the main claim. Such combined electric circuit components which simultaneously effect a switching motion and an adjustment motion or which in any event bring these into a time relationship with each other are known in a multiplicity of forms—here mention is made of one embodiment which is representative of many others, i.e. that described in No. De-OS 27 46 481, where an apparatus effecting switching and simultaneous adjustment of electrical influence factors incorporates a rotary potentiometer having a contour with a fixed axis of rotation for actuating separate and adjacent switching units that are mounted on a printed circuit board, for example, and may be constituted by microswitches or the like, when a predetermined position, usually an end position, is reached when the potentiometer is turned. Such switch-potentiometer combinations frequently serve as half-wave control and full-wave control arrangements employing thyristors or triacs, whereby either the whole control system is switched on in predetermined positions or a maximum position is reached for full-wave triggering by a switching operation, if required.

The construction of such switch/rotary potentiometer combinations is usually complicated and expensive since even when assemblies are mounted directly onto printed circuit boards, the resistor track on the latter usually has to be secured in any event on each side by rivets and the switches often have to be mounted as separate components adjacent to the circumferential contour of the potentiometer exhibiting cams, so that they must have their own casing or at least holders for the wipers and the like.

It is, therefore, the object of the present invention to provide a combined rotary potentiometer and switch in considerably simplified and particularly inexpensive fashion as a separate component that can be attached to control and regulating systems at any point, for example, as a final control element with switching characteristics.

ADVANTAGES OF THE INVENTION

The invention achieves this object with the characteristic features of the main claim and has the advantage that only five additional parts are necessary when using and installing the potentiometer as an independent, enclosed, prefabricated component in order to arrive at a rotary potentiometer/switch combination that operates perfectly and exhibits excellent linearity and previously unattainable cost economy. At the same time, assembly costs in the manufacture of such a combination are decisively reduced with the added advantage that the finally assembled combined component can be introduced without difficulty into any type of circuit and preferably even in prefabricated printed circuit boards, whereby the requisite printed circuit board connections are at once provided automatically.

The additional measures listed in the subclaims permit advantageous further embodiments and improvements of the rotary potentiometer with switch described in the main claim. A specially advantageous arrangement is obtained by the provision of an external hemispherical casing as a receptacle to house the prefabricated small rotary potentiometer, the said casing having an internal contour corresponding to the outer shape of the potentiometer component to be inserted and can accommodate the metallic wipers as well as the connecting contact strips and springs within recesses or compartments in the wall of the casing.

Finally, it is advantageous to employ a sort of cam ring as an additional arrangement, which is seated loosely on the rotational axis of the potentiometer, but so as not to rotate, thus facilitating snap switch action (instantaneous switching) by the respective switch when a predetermined angular position has been attained.

DRAWING

One embodiment of the invention is represented in the drawing and will be explained in more detail in the hereafter.

DESCRIPTION OF THE EMBODIMENTS OF THE INVENTION

The basic conception of the present invention is to provide a completely enclosed small potentiometer that has a through-opening for rotary actuation and a further upper casing to accommodate the said small potentiometer and seat it for use, the said upper casing having at the same time the additional function of housing the appropriate switching components, contact member support, flexible wipers and connecting lugs for the switch so that switch actuation is effected simultaneously when rotation takes place about the plug-in axis of the potentiometer, this axis serving at the same time to retain the small potentiometer in the hemispherical casing in which it is housed, either by a locating device employing rear-acting detent tongues which give way initially during insertion, or also by welding one end of the axis pin in the through-opening, for example, by heating and melting the plastic material in the proximity of the axis pin.

Figure 1:
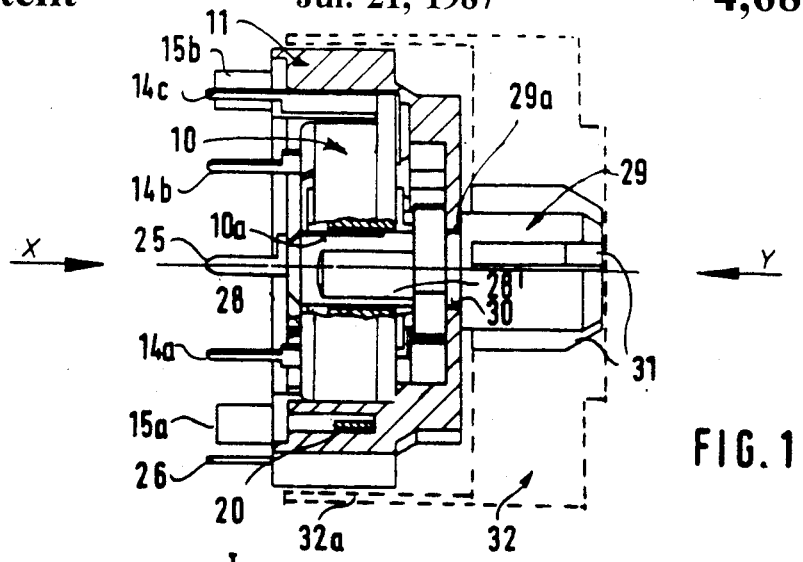
FIG. 1 shows the combination according to this invention, comprising a rotary potentiometer and switch in a lateral section along line I—I in FIG. 2.
Figure 2:
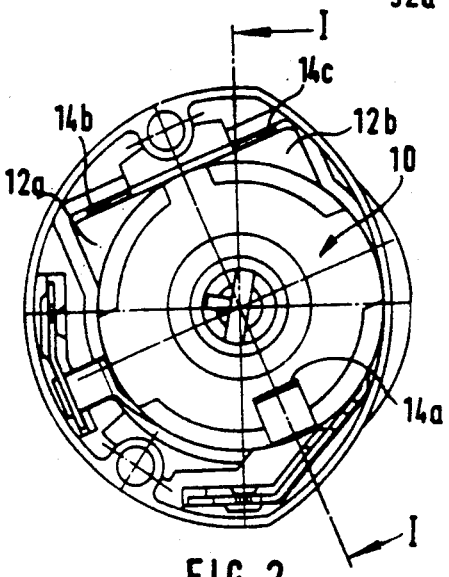
FIG. 2 shows the embodiment of the invention as depicted in FIG. 1, giving a top view from direction X in FIG. 1.

FIG. 1 shows at 10 a cup-shaped or hemispherical upper casing 11 in which a small potentiometer is inserted. It should be added that this small potentiometer is an enclosed, prefabricated rotary potentiometer component with its own casing and is preferably completely encapsulated in the form of a circular cylindrical disc and provided only with a central through-opening for the axis of rotation, which is preferably non-circular, to that this axial pin can then rest in this opening, secured against rotation; in FIG. 1 this opening is designated 10*a*. An additional, generally valid advantage with such prefabricated small rotary potentiometers is that they can be manufactured fully automatically, and hence at very low cost while at the same time ensuring perfectly good functional characteristics. The general shape of the complete rotary potentiometer is complemented in the lower region, i.e. in the area where the rotary potentiometer rests on the bottom of the cup-shaped casing 10, by two radially protruding lobes or shoulders 12*a*, 12*b* (FIG. 2) which serve as connecting contact strips and at the same time result in the annular structure of the rotary potentiometer at this point being converted into a rectangular shape, with the result that the entire assembly is non-circular and enables the inserted potentiometer 10 to be secured against rotation in the upper casing 11 by a corresponding rectangular inner contour 13 in the receptacle portion of the upper casing.

There is no need to further consider the internal structure of the prefabricated small rotary potentiometer as this is not the subject of the invention; the simple construction of such a potentiometer is completed only by three contact prongs which extend outwards, namely a first prong 14*a* which carries the pick-off potential and two further prongs 14*b*, 14*c*, which concern the two terminating connections of the resistor track. Once inserted into the upper casing 11 (cf FIG. 1), these prongs protrude beyond the closure surface, i.e. the right surface in the drawing and the lower surface relative to the rotary potentiometer-switch combination, and project in the same direction as two locating and bearing journals 15*a*, 15*b* positioned on the upper casing, which are preferably formed integrally with the plastic material of the upper casing, so that a rotary potentiometer and switch combination constructed in this manner can be inserted into corresponding mounting and locating bores of, say, a printed circuit board that has aligned bores for the passage of the contact prongs of the potentiometer and—as is moreover explained farther on—of the switch or switches, and can thus be secured. The prongs then project through to the opposite conductor track surface from the component side of the printed circuit board and can there by connected electrically with the respective printed conductors, for example by dip soldering.

Certain important features of the present invention can be seen best in the representation in FIG. 3, which gives a view from below into the hemispherical upper casing with its switching contacts, with the small potentiometer 10 removed.

It can be seen that, in addition to this non-circular inner configuration provided by contour 13 for receiving the potentiometer, this wall ends in parallel wall sections 16, 17, 18 with respect to outer wall 11*a* at predetermined points along circular wall 11*a* of upper casing 11, which can be regarded as internal peripheral compartments and serve to accommodate switch components which are inserted at this position. These double walls 16, 17, 18, together with outer annular wall 11*a*, constitute downwardly open groove receptacles or slots in which the rear cross-member 19*b* of a spring-loaded wiper 19, as well as the rear end 20*a* of a stationary opposite tongue 20 are held resiliently by pressure and friction. Proceeding from cross-member 19*b*, with which the spring-mounted wiper 19 is connected as a unitary whole via intermediate member 21, the said wiper 19 exhibits a multiplicity of bends so that in any event a loop-shaped inwardly bent bulge 19*a* is formed which constitutes the point of engagement for a cam face 22 which then runs up onto the bulge 19*a* and thereby detaches the wiper 19 in the direction of the outer edge of the upper casing 11 when an axle pin that is coupled to the cam member 22 performs a rotational motion in the direction of arrow A. The bulge 19*a* then shifts to a position underneath the cam 22*a* constituted by cam surface 22 so that contact member 23 on wiper 19 is pressed onto opposite tongue contact 20 with a predetermined contact pressure in case of 24, preferably with a predetermined overstroke.

The movable wiper 19 and the stationary opposite contact 20 preferably consist of a suitable metallic spring alloy and are overall of unitary construction with their bearing and cross-members, the said cross-members ending at the same time at 25 and 26 in protruding contact prongs extending vertically in the plane of the drawing, thus completing the structure of contact terminals for the combination.

According to a preferred embodiment of the present invention, the component which features the trip cam 22*a* for switch actuation consists of a cam ring 27 which exhibits a central, non-circular through passage 28 and rests on the bottom of the upper casing in a corresponding recess as the lowermost part and is passed by the axle stub of the fulcrum pin 29. The overall construction is consequently such as can be best deduced from the representation in FIG. 1; the bottom of the cup-shaped upper casing 11 exhibits a central passageway 30 through which the axle stub 28 of the fulcrum pin 29 is led; finally, the cam member 27 for activation of the switch is seated on the axle stub and the axle stub is led through the non-circular passageway 10*a* of small the potentiometer 10 and the portion projecting outwards is then either fixed by expanding and melting or is anchored by edge zones of the passageway of potentiometer 10 which are engaged at the rear by detent lugs. On the other side, the fulcrum pin rests with an extended shoulder 29*a* on the external surface of upper casing 11 so that the assembly is held together safely. The fulcrum pin 29 can, moreover, exhibit wing-like extensions, as indicated at 31, so that an actuating button can be pushed on; such an actuating button is indicated at 32 and a preferred embodiment of the present invention provides that this actuating button, which may at least partially overlap the entire assembly combination by an annular apron 32*a* extending downwardly a considerable length, is fabricated integrally with the fulcrum pin 29 and provided at its periphery with grooving.

Finally, an additional advantageous feature of the present invention consists in positioning the cam ring 27 with free rotational play, i.e. with a predetermined free clearance on the axle stub 28, so as to provide a snap-locking effect when, upon rotation of the cam 22*a*, the cam ring 27 can be pushed away by predetermined angular amounts suddenly under the spring action of wiper 19, independently of any further rotational movement, at that moment when cam face 22 is induced to finally release bulge 19*a*, whereby the switch 19/23/24 abruptly opens and spark formation is avoided.

Figure 3:
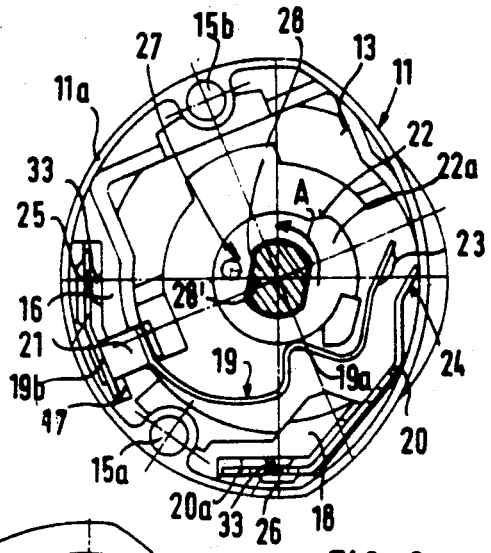
FIG. 3 shows the same representation as in FIG. 2, but with the small potentiometer removed.
Figure 4:
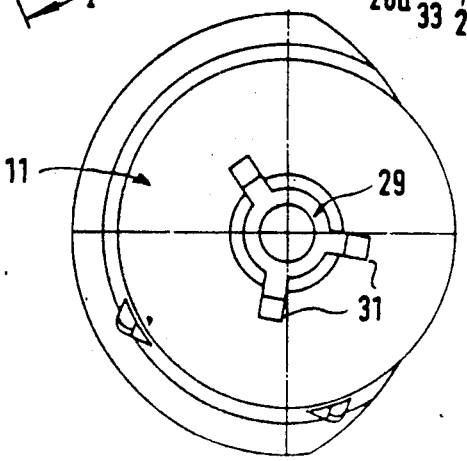
FIG. 4 shows the embodiment of the invention in FIG. 1, giving a top view from direction Y in FIG. 1.

During assembly, the metallic components comprising the wiper 19 and the fixed contact 20 are inserted into the receiving grooves from above, as seen with respect to the plane of drawing in FIG. 3. The parallel walls 16, 17, 18 may, during this process partially give way and may then firmly grip the respective metal parts under pressure by virtue of the point-like rest, as indicated at 33.

It is understood that the special type and configuration of the switches to be actuated in the course of potentiometer adjustment is arbitrary; for example, following appropriate cam conversion and alteration of the rotational range, the switch may take the form of a mains switch and be closed during initial rotary motion of the potentiometer; it is also possible to accommodate more than one switch in upper casing 11, for example, in superimposed planes which can then be actuated by superimposed cam rings 27 arranged in the same fashion. The overall height is changed only insignificantly as a result of this. In this manner, it is possible, for example, to close a mains switch during initial rotation of the potentiometer and to actuate a so-called max. switch which switches through the respective mains half wave to the apparatus if half-wave or full-wave triggering is applicable. i.e. by-passing the phase-shifting control, if any.

All of the features contained in the specification, in the following claims and in the drawing may be essential to the invention, either individually or in any combination thereof.

I claim:

1. Rotary potentiometer with switch, comprising a wiper that runs on a resistor track and at least one switch that can be actuated by the rotary motion of a fulcrum pin simultaneously, preferably when reaching the potentiometer end position, characterized in that an enclosed, prefabricated rotary potentiometer component (10) with its own casing and external connecting tongues (14*a*, 14*b*, 14*c*) is inserted in an additional, cup-shaped upper casing that is open on one side and in which switching contact supports are located which are held in place by wall sections (16, 17, 18) of the additional casing (11), the said switching contact supports being switched by a cam actuating member (cam ring 27) attached to a fulcrum pin (29) that simultaneously effects the rotation and the mounting of the potentiometer component (10) in the upper casing.

2. Rotary potentiometer with switch according to claim 1, characterized in that wall sections of the upper casing (11) holding the switching contact supports (19, 20) are integrally designed and form with the outer wall (11*a*) groove receptacles constituted by parallel wall sections that are offset inwards, firmly holding and retaining the inserted switching contact supports.

3. Rotary potentiometer with switch according to claim 1, characterized in that the fulcrum pin (29) passes through a bottom opening (30) in the upper casing (11) and penetrates initially through the cam ring (27) which caused the movements of the switching contact supports (19, 20), and subsequently through the opening (10*a*) of the potentiometer component (10) and is held in locking engagement therewith on the opposite side.

4. Rotary potentiometer with switch according to claim 3, characterized in that the axle stub of the through passageway (10*a*) of the potentiometer component (10) is gripped at the rear.

5. Rotary potentiometer with switch according to claim 3, characterized in that the cam ring (27) is seated on the fulcrum pin (29) in order to achieve a snap switch action.

6. Rotary potentiometer with switch according to claim 1, characterized in that a first switching contact support (20) is held stationary on the inner wall of the upper casing (11) and a second switching contact carrier (19) is held on the cam ring (27) so as to move in response to the action of a cam (22*a*), and features a bulge (19*a*) where the cam (22*a*) of the cam ring (27) engages for switch actuation.

7. Rotary potentiometer with switch according to claim 1, characterized in that the upper casing (11) features bearing and locating journals (15*a*, 15*b*).

8. Rotary potentiometer with switch according to claim 1, characterized in that contact prongs (14*a*, 14*b*, 14*c*; 25, 26) emerge from the rotary potentiometer component (10) and from the switching contact supports (19, 20) and extend in the same direction as the bearing journals (15*a*, 15*b*) of the upper casing (11) in such a manner that the rotary potentiometer and switch combination can be directly attached to a printed circuit board and the prongs on the printed circuit board side can be electrically connected to printed conductors.

9. Rotary potentiometer with switch according to claim 1, characterized in that the fulcrum pin (29) is preferably formed integrally with the rotary knob (32).

10. Rotary potentiometer with switch according to claim 9, characterized in that the rotary knob (32) covers the rotary potentiometer/switch assembly by a downwardly extended apron (32*a*).

* * * * *